US010974931B2

(12) United States Patent
Krämer et al.

(10) Patent No.: US 10,974,931 B2
(45) Date of Patent: Apr. 13, 2021

(54) RUN-IN GUIDE RAIL FOR ESCALATORS OR MOVING WALKWAYS AND PASSENGER CONVEYANCE DEVICE HAVING A RUN-IN GUIDE RAIL OF THIS KIND

(71) Applicant: TK Elevator Innovation and Operations GmbH, Essen (DE)

(72) Inventors: Reinhardt Krämer, Hamburg (DE); Gerrit Brand, Hamburg (DE)

(73) Assignee: TK Elevator Innovation and Operations GmbH, Essen (DE)

( * ) Notice: Subject to any disclaimer, the term of this patent is extended or adjusted under 35 U.S.C. 154(b) by 0 days.

(21) Appl. No.: 16/842,254

(22) Filed: Apr. 7, 2020

(65) Prior Publication Data

US 2020/0325004 A1 Oct. 15, 2020

(30) Foreign Application Priority Data

Apr. 11, 2019 (DE) ..... 10 2019 205 244.4

(51) Int. Cl.

| | |
|---|---|
| ***B66B 23/14*** | (2006.01) |
| ***B66B 21/04*** | (2006.01) |
| ***B66B 21/10*** | (2006.01) |
| ***B66B 23/02*** | (2006.01) |

(52) U.S. Cl.

CPC ..... *B66B 23/14* (2013.01); *B66B 21/04* (2013.01); *B66B 21/10* (2013.01); *B66B 23/145* (2013.01); *B66B 23/026* (2013.01)

(58) Field of Classification Search

CPC ..... B66B 23/14; B66B 21/04; B66B 21/10; B66B 23/145; B66B 23/147; B66B 23/026

USPC ..... 198/321, 326, 330

See application file for complete search history.

(56) References Cited

U.S. PATENT DOCUMENTS 2,656,031 A * 10/1953 Masek ..... B66B 23/145 198/332
2,940,578 A * 6/1960 Clemetsen ..... B66B 23/02 198/329
4,235,326 A * 11/1980 Nakao ..... B66B 23/02 198/326
5,697,486 A 12/1997 Krampl (Continued)

FOREIGN PATENT DOCUMENTS

DE 10 2015 212 031 A 12/2016
DE 10 2017 217 721.7 4/2019

(Continued)

OTHER PUBLICATIONS

Extended European Search Report dated Sep. 14, 2020, in counterpart European Application No. 20163857.4.

*Primary Examiner* — James R Bidwell
(74) *Attorney, Agent, or Firm* — William J. Cassin

(57) ABSTRACT

A run-in guide rail for escalators or moving walkways. The run-in guide rail is configured to support a step chain with buffer rollers arranged internally and track rollers arranged externally during the run-in into a sprocket. The run-in guide rail has a first support surface for supporting the buffer rollers and a second support surface, arranged alongside the first support surface, for supporting the buffer rollers. In addition, a passenger conveyance device comprising step chains, sprockets and at least one aforementioned run-in guide rail is disclosed.

15 Claims, 4 Drawing Sheets

(56) References Cited

U.S. PATENT DOCUMENTS

| | | | | |
|---|---|---|---|---|
| 6,834,754 | B2 * | 12/2004 | Pietz | B66B 23/026 198/330 |
| 8,083,048 | B2 * | 12/2011 | Ishikawa | B66B 23/022 198/326 |
| 10,464,785 | B2 | 11/2019 | Ludwig | |
| 2005/0061609 | A1 | 3/2005 | Pietz | |
| 2007/0007106 | A1 * | 1/2007 | Ishikawa | B66B 23/022 198/330 |
| 2015/0344269 | A1 * | 12/2015 | Makovec | B66B 23/12 198/326 |
| 2017/0210602 | A1 | 7/2017 | Schulz | |

FOREIGN PATENT DOCUMENTS

| | | | |
|---|---|---|---|
| EP | 0 711 725 | A | 5/1996 |
| WO | 2014/086716 | A1 | 6/2014 |
| WO | 2015/180965 | A | 12/2015 |
| WO | 2019/120916 | A1 | 6/2019 |

* cited by examiner

RUN-IN GUIDE RAIL FOR ESCALATORS OR MOVING WALKWAYS AND PASSENGER CONVEYANCE DEVICE HAVING A RUN-IN GUIDE RAIL OF THIS KIND

CROSS REFERENCE TO RELATED APPLICATION

This application is a U.S. Non-Provisional patent application, which claims priority to German Patent Application No. DE 10 2019 205 244.4, filed Apr. 11, 2019, the entire content of which is incorporated herein by reference.

FIELD

The present disclosure generally relates to a run-in guide rail for escalators or moving walkways.

BACKGROUND

Run-in guide rails are used to reduce vibrations in the step chain of a passenger conveyance device during the run-in into the respective sprocket and thereby in particular improve the quiet running of the passenger conveyance device. With increasing chain pitch—something that is attractive particularly due to cost considerations—the problem of the step chain vibrating during the run-in into a sprocket increases.

It is known from EP 0 711 725 A1, in the case of a step chain, for chain rollers arranged within the chain links to be used as track rollers and for these to be guided over running surfaces. In other words, these chain rollers are firstly used as track rollers and, moreover, are each temporarily engaged with the corresponding sprockets for the purposes of driving the step chain. In this respect, however, this step chain has no buffer rollers arranged within the chain links and track rollers arranged outside the chain links. The external arrangement of track rollers is however advantageous, particularly in the case of large, heavy passenger conveyance devices. This is because the wear of the track rollers is greater in the case of passenger conveyance devices of this kind, such as for example in the case of particularly long escalators, than in the case of short, light escalators. The arrangement of the track rollers outside the chain links in this case means that the replacement of track rollers of this kind is made substantially easier and is possible within substantially shorter periods of time than is the case with internal track rollers. Consequently, possible downtime resulting from the need to replace track rollers is substantially reduced. Track rollers arranged outside the chain links are also not used for engagement with the sprockets in this case. This takes place by means of the internally situated buffer rollers. In this case, the additional track rollers outside the chain links mean that the wear of the internally situated buffer rollers of a step chain is advantageously reduced. A step chain of this kind which has track rollers arranged externally and buffer rollers arranged internally and which can be used particularly advantageously along with the present invention is described for example in DE 10 2015 212 031 A1.

DE 10 2017 217 721.7 discloses a passenger conveyance device in which a step chain with buffer rollers arranged internally and track rollers arranged externally is supported during the run-in into a sprocket. In this case, a first running surface is provided on which the track rollers roll between the sprockets. Moreover, a run-in guide rail is provided which has a second running surface which supports the buffer rollers during the run-in into the sprocket. In this respect, the support of the track rollers changes to support of the buffer rollers during the run-in into a sprocket. The occurrence of vibrations in the step chain during the run-in into the sprocket is not entirely prevented here. In addition, the buffer rollers are subjected to greater stress owing to the support.

Thus a need exists to further reduce the occurrence of vibrations in a step chain with buffer rollers arranged internally, in other words within the chain links, and track rollers arranged externally, in other words outside the chain links, during the run-in into a sprocket.

DETAILED DESCRIPTION

Figure 1:
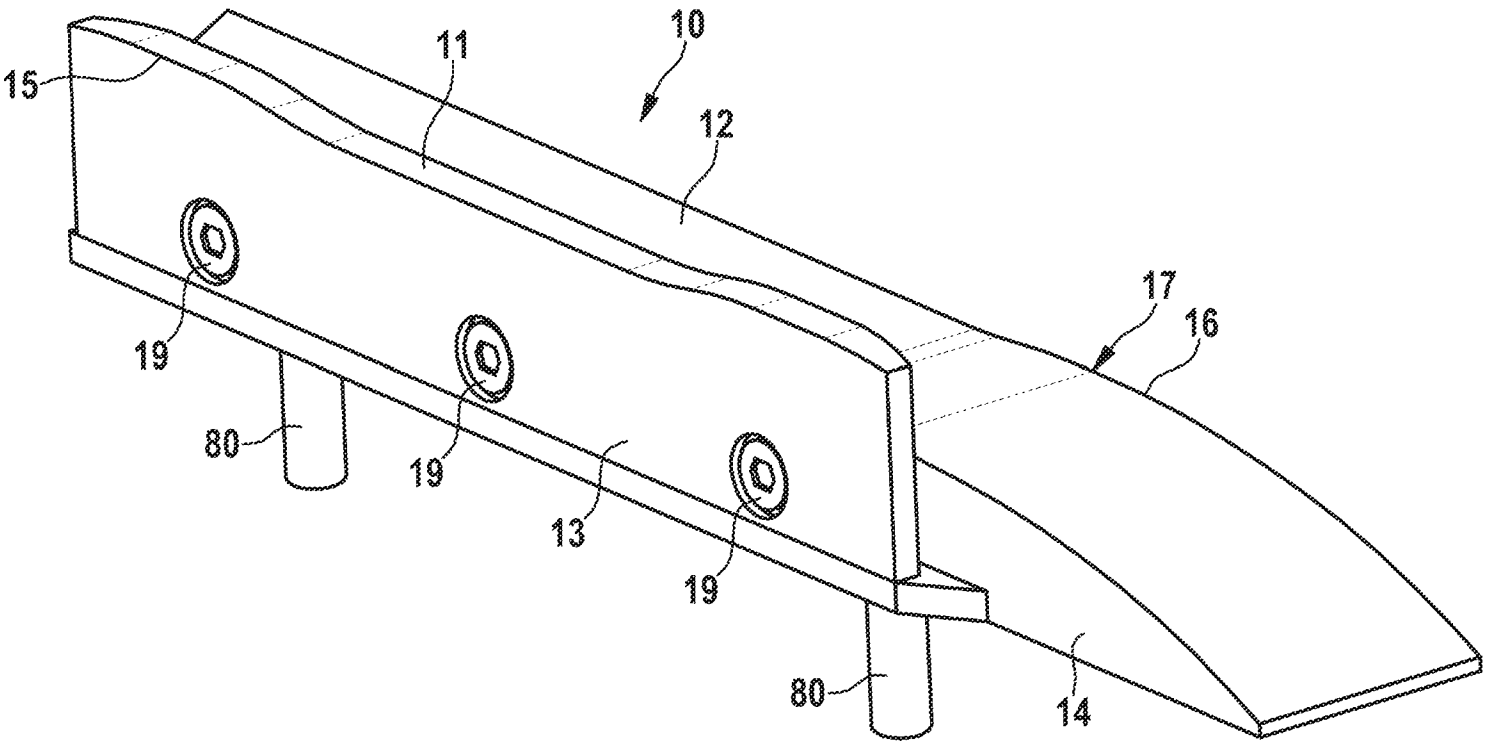
FIG. 1 is a perspective view of an exemplary embodiment of a run-in guide rail.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The invention relates to a run-in guide rail for escalators or moving walkways which is designed for supporting a step chain with buffer rollers arranged internally and track rollers arranged externally during the run-in into a sprocket. Moreover, the invention relates to a passenger conveyance device, in particular an escalator or a moving walkway, having at least one step chain, at least one sprocket and at least one run-in guide rail, wherein the step chain comprises buffer rollers arranged internally and track rollers arranged externally.

The proposed solution provides a run-in guide rail for escalators or moving walkways which is configured for supporting a step chain with buffer rollers arranged internally and track rollers arranged externally during the run-in into a sprocket. The run-in guide rail in this case has a first support surface for supporting the buffer rollers and a second support surface for supporting the track rollers. The second support surface is in this case arranged alongside the first support surface. The embodiment with a first support surface and a second support surface arranged alongside the first support surface means that advantageously both the track rollers and the buffer rollers are supported during the run-in into the sprocket. This is particularly advantageous because, in particular in a manner dependent on the chain pitch, a track roller is not normally arranged at each connection point of the chain links, and the number of track rollers is therefore smaller than the number of buffer rollers. If exclusively the track rollers were supported, the step chain would therefore vibrate comparatively vigorously in the region between two track rollers. This leads, in particular, to an unsteady run-in of the step chain into the sprocket. The first support surface therefore ensures a reduction in vibrations and an improvement in quiet running. If exclusively the buffer rollers were supported, they would however be subjected to greater stress. It is therefore advantageous for the track rollers to likewise be supported during the run-in into the sprocket.

In particular, it is provided that the first support surface has a narrower width than the second support surface. The sprocket width and the width of the first support surface in this case are advantageously adapted to the step chain in such a manner that the buffer rollers of the step chain can run into the sprocket and, during this, can be laterally supported by the first support surface of the run-in guide rail. The first support surface therefore in particular does not support the buffer rollers over the entire roller width. In particular, the buffer rollers are only supported at one side region. It is furthermore in particular provided that the buffer rollers do not project beyond the chain links of the step chain. In this respect, the buffer rollers in particular exhibit a diameter which is the same as, or smaller than, the height of the chain plates. The width of the second support surface is advantageously adapted to the step chain in such a manner that the track rollers can be supported over their entire running surface width by the second support surfaces.

In particular, the buffer rollers are each supported by means of the first support surface in such a manner that the buffer rollers supported by the first support surfaces are in parallel engagement with the sprocket, particularly in the region of the upper dead centre of the sprocket. In other words, the buffer rollers can advantageously make contact with both the sprocket and the first support surface, particularly in the region of the upper dead centre of the sprocket. In particular, the buffer rollers are not released by the first support surface, in particular not even sectionally, but remain in loaded engagement with the sprocket, in particular as far as the upper dead centre of the sprocket, in particular at the upper dead centre of the sprocket. In this respect, the first support surface is in particular not provided for preventing contact between the sprocket and the buffer roller supported by the first support surface. The first support surface advantageously stabilizes the run-in of the buffer rollers into the sprocket and advantageously leads to a reduced vibration of the step chain.

According to a further advantageous embodiment, it is provided that the first support surface is shorter in design than the second support surface of the run-in guide rail. In particular, it is provided that the first support surface of the run-in guide rail does not project beyond the dead centre of the sprocket, whereas it can be provided that the second support surface projects beyond the dead centre of the sprocket. In particular, it is provided that the run-in guide rail has a length of between 200 mm and 500 mm, in particular between 300 mm and 400 mm. In particular, it may be provided in this case that the longitudinal extent of the second support surface corresponds to the total length of the run-in guide rail. The longitudinal extent of the first support surface may, in particular, correspond to 50% to 80% of the total length of the run-in guide rail.

According to a particularly advantageous embodiment of the run-in guide rail, the first support surface is made of a first material and the second support surface is made of a second material. The first material is in this case advantageously more elastically resilient than the second material. In particular, the first material preferably has better damping properties than the second material. Advantageously, the first support surface is made of a plastic and the second support surface is made of metal, in particular steel. Polyamide, in particular, is provided as the first material. A nylon plastic is particularly advantageous as the first material. The commercially available Nylatron® GSM has proved particularly advantageous as the first material, in particular on account of its high mechanical damping capacity and also its good sliding properties.

Moreover, it is in particular provided that the first support surface and the second support surface are arranged offset with respect to one another in terms of height. The first support surface in this case has in particular a higher arrangement height than the second support surface. The run-in guide rail is therefore advantageously adapted to the fact that the track rollers of the step chain customarily have a larger diameter than the buffer rollers of the step chain.

A further advantageous embodiment provides a multi-piece design of the run-in guide rail. It is advantageously the case here that a first piece of the run-in guide rail is a first component which has the first support surface and a second piece of the run-in guide rail is a second component which has the second support surface. This may advantageously make it easier to install the run-in guide rail. More advantageously, in the event of a defect, the component involved can be individually replaced. A further advantage can be seen in the fact that the height offset described above can be easily adjusted on account of different diameters of the buffer rollers and of the track rollers. In particular, it may be provided that the first component and the second component are connection-free. In the case of an embodiment of this kind, it is in particular provided that the first component and the second component are not directly connected to one another. Instead, it is in particular provided that the first component is arranged on an element of a passenger conveyance device and the second component is arranged on an element of this passenger conveyance device. According to a further advantageous embodiment of a multi-piece run-in guide rail, it is provided that the first component is mounted at the second component, in particular by means of a screw connection.

According to a further advantageous embodiment of the invention, the run-in guide rail has a first height profile of the first support surface which changes over the longitudinal extent direction of the run-in guide rail. In this embodiment, the first support surface is in particular not planar in design. In particular, it is provided that the first height profile is also not linear in design. In particular, it is provided that the first height profile corresponds to a curve profile, wherein the curve profile may be continuous. In particular, however, a discontinuous curve profile may also be provided as the first height profile. The first height profile which changes over the longitudinal extent direction is advantageously adapted to the movement of the buffer rollers which are supported by the first support surface. Advantageously, the first height profile is determined in a manner dependent on the chain pitch of the step chain. The chain pitch of the step chain is in this case determined in turn in particular from the width of the steps or palettes of the passenger conveyance device. In particular, a chain pitch of the step chain of 135 mm may be provided, wherein the step chain has two buffer rollers between two track rollers in each case, the number of buffer rollers therefore being greater by a factor of three than the number of track rollers.

Starting from a designated arrangement position of the run-in guide rail for the support of the step chain during the run-in into a sprocket, the first height profile is advantageously configured in such a manner that it describes the minimum turning points of the at least one buffer roller which is arranged between two track rollers, disregarding the dead weight, during the run-in into the sprocket. The minimum turning points are in this case advantageously determined on the basis of a simulation of the theoretical curve profile of those buffer rollers which are arranged between in each case two consecutive track rollers during the run-in into a sprocket, disregarding the dead weight of the step chain. The arrangement of the first support surface and the formation of the height profile are in this case advantageously realized such that the buffer rollers would make contact with the support surface at the determined minimum turning points. The further first height profile of the first support surface is in this case advantageously determined in such a manner that it advantageously remains below the simulated curve profile, preferably 0 mm to 15 mm (mm: millimetre) below the simulated curve profile. This gives rise to the extremely advantageous effect that the buffer rollers make contact with the first support surface during an actual run-in into the sprocket. In this case, advantageously substantially only the dead weight of the buffer roller is supported by the first support surface. In particular, it may also be provided that the weight of the step chain is likewise co-supported. An additional action of load on the first support surface owing to the so-called polygon effect is advantageously prevented by the embodiment. The buffer rollers supported by the first support surface are therefore advantageously not loaded with the weight of the chain plates and bolts of the step chain. As a further advantageous effect, it is achieved that the buffer rollers always run into the sprocket at the same height, which further improves quiet running. Moreover, damping elements used between the teeth of the sprocket are advantageously evenly loaded and therefore wear evenly, as a result of which quiet running is improved still further.

A further advantageous embodiment of the invention provides a second height profile of the second support surface which changes over the longitudinal extent direction of the run-in guide rail. The second height profile is in this case advantageously adapted to the profile of the track rollers during the run-in into a sprocket in such a manner that the step chain is supported even more effectively and quiet running is further enhanced.

Advantageously, starting from a designated arrangement position of the run-in guide rail for the support of the step chain during the run-in into a sprocket, the second height profile is determined in such a manner that the second height profile exhibits a maximum. This maximum advantageously lies in a region about a perpendicular projection of the dead centre of the sprocket onto the second support surface. This region advantageously begins up to 10 mm, in particular up to 5 mm, before the perpendicular projection of the dead centre of the sprocket onto the second support surface. More advantageously, this region ends up to 10 mm, in particular up to 5 mm, after the perpendicular projection of the dead centre of the sprocket onto the second support surface. The incipient engagement of the buffer rollers with the sprocket is thereby advantageously improved. This embodiment is particularly advantageous if damping elements are used between the teeth of the sprocket. The damping elements are in this case evenly loaded and wear evenly. This further contributes to improved quiet running.

In a further advantageous embodiment, the second height profile of the second support surface describes a falling curve starting from the maximum beyond the perpendicular projection of the dead centre, that is to say in particular beyond the region about the perpendicular projection of the dead centre, wherein the falling curve in particular follows the circular path which a track roller of the driven step chain covers, in particular would theoretically cover without support by the run-in guide rail, in particular in the corresponding region in which the second support surface is arranged. Quiet running of the step chain is hereby advantageously furthermore improved.

A further advantageous embodiment provides that the first height profile and/or the second height profile is/are mirror-symmetrical in relation to a perpendicular running through the run-in guide rail. In particular, the first height profile of the first support surface of the run-in guide rail is configured symmetrically in relation to a perpendicular running through the centre of the first support surface of the run-in guide rail. In particular, the second height profile of the second support surface of the run-in guide rail is configured symmetrically in relation to a perpendicular running through the centre of the second support surface. The symmetrical embodiment in this case has the advantage that the run-in guide rail can be flexibly configured. It is thus in particular provided that the first support surface can be arranged in such a manner in relation to the second support surface that the run-in guide rail can be used at each sprocket of a passenger conveyance device for the purposes of supporting the step chain during the run-in into the sprocket. In particular, it is therefore not necessary to produce different support surfaces for arrangement at the respective different sprockets. According to a further advantageous embodiment, the run-in guide rail is itself of symmetrical design.

The passenger conveyance device proposed for solving the problem referred to in the introduction, which is in particular an escalator or a moving walkway, comprises at least one step chain with buffer rollers arranged internally and track rollers arranged externally, comprises at least one sprocket and comprises a run-in guide rail configured according to the invention, in particular a run-in guide rail according to an embodiment as described above or in the claims of the application. In particular, the passenger conveyance device comprises a continuous conveyor belt formed from a plurality of tread elements. In particular, the tread elements of the conveyor belt are connected to the step chain. In particular, it is provided that in each case one step chain to each side of the conveyor belt is connected to the conveyor belt for the purposes of driving said conveyor belt. The step chains of the passenger conveyance device comprise in particular a plurality of chain links which are movable with respect to one another, with buffer rollers arranged within the chain links and track rollers arranged outside the chain links. The passenger conveyance device furthermore comprises in particular sprockets for driving and deflecting the step chains, wherein it is in particular provided that the buffer rollers are each temporarily engaged with one of the sprockets during the driving of the step chains. In particular, it is provided that two sprockets in each case drive and deflect a step chain. In this case, each sprocket is preferably connected via an axle to another sprocket, wherein these sprockets in particular drive and deflect in each case one step chain arranged to the left and to the right alongside the conveyor belt, wherein the conveyor belt is driven by means of the step chains. It is furthermore provided in particular that the proposed passenger conveyance device comprises first running surfaces on which the track rollers of the driven step chains roll, in particular along the conveying path. The first running surfaces are in this case advantageously each arranged and dimensioned such that they guide the track rollers of the step chains, between the sprockets driving a step chain, along the conveying path but in particular no longer during the run-in of the step chain into a sprocket. In particular, metal rails are provided as first running surfaces. In particular, it is provided that a respective run-in guide rail adjoins a respective first running surface.

The proposed passenger conveyance device is advantageously designed for high passenger volumes. It is furthermore advantageous for the proposed passenger conveyance device to be designed to cover large distances, in particular to cover distances greater than 15 m, more particularly to cover distances greater than 20 m. Embodiments of passenger conveyance devices with a shorter-distance conveyor belt advantageously also benefit from the use of the run-in guide rail according to the invention.

A further advantageous embodiment of the passenger conveyance device provides that the step chains are assigned in each case one track roller for each tread element. If the passenger conveyance device is an escalator, it is therefore in particular provided that the step chains comprise in each case one track roller per escalator step. The track rollers in this case advantageously support the weight of the respective tread element. In addition, the track rollers are pressed by the weight of the respective tread elements against the first running surfaces, as a result of which the track rollers advantageously run over the first track rollers with very quiet running.

A further advantageous embodiment of the proposed passenger conveyance device provides that the step chains each have a chain pitch of at least 100 mm (mm: millimetre). It is in particular provided that the step chains of the passenger conveyance device each have a chain pitch of 135 mm. Particularly in the case of long passenger conveyance devices, such as in particular escalators with a conveying length of more than ten metres, in particular more than 15 metres, costs can thereby advantageously be saved. However, the chain pitch should advantageously be smaller than 200 mm.

The effect whereby a greater chain pitch normally leads to a reduction in the quiet running of the passenger conveyance device, particularly if the diameter of the sprockets driving the step chains is to remain substantially unchanged and the number of teeth of the sprockets is therefore correspondingly reduced, is advantageously counteracted in this case through the guidance of the buffer rollers during the run-in into the respective sprocket.

In particular, it is provided that the sprockets of the passenger conveyance device have a pitch circle diameter of at most 750 mm, in particular a pitch circle diameter of less than 700 mm. According to a further embodiment, the sprockets of the passenger conveyance device advantageously each have a maximum number of teeth of 20, preferably a number of teeth of 16.

In particular, it is provided that the respective run-in guide rail is arranged in relation to the respective sprocket in such a manner that the first support surface faces towards the sprocket, so that the buffer rollers of the respective step chain are supported during the run-in into the sprocket in a side region of said buffer rollers by the first support surface, and wherein the second support surface faces away from the sprocket, so that the track rollers of this step chain are supported during the run-in into the sprocket by the second support surface.

In particular, it is provided that the respective run-in guide rail is arranged in the run-in region of a respective sprocket of the passenger conveyance device, but not in the return run, that is to say not in the lower region of a sprocket. Consequently, in the case of a passenger conveyance device, it is customarily the case that four sprockets are provided for a run-in guide rail. The step chains of a passenger conveyance device are advantageously supported during the run-out from a sprocket too, as a result of which vibrations are further reduced.

FIG. 1 shows an exemplary embodiment of a run-in guide rail 10 for escalators or moving walkways. By means of fastening elements 80, in particular threaded bolts, the run-in guide rail 10 in this case can be arranged in a designated manner on an escalator or a moving walkway in the region of a sprocket. The run-in guide rail 10 has a first support surface 11 and a second support surface 12 arranged alongside the first support surface 11. The run-in guide rail 10 is in this case used for supporting a step chain of an escalator or of a moving walkway with buffer rollers arranged within the chain links and track rollers arranged outside the chain links during the run-in into a sprocket, wherein the number of track rollers is smaller than the number of buffer rollers and the track rollers have a larger diameter than the buffer rollers. The track rollers of a step chain are supported by means of the second support surfaces 12 in this case, wherein it is in particular provided that the track rollers can roll over the second support surface 12 over their entire width. The buffer rollers, in particular the buffer rollers at those points of the step chain at which no track rollers are arranged, in other words those buffer rollers between two consecutive track rollers in each case, are supported by means of the first support surface 11.

In the exemplary embodiment shown in FIG. 1, the run-in guide rail 10 has a multi-piece configuration. The run-in guide rail 10 therefore comprises multiple individual components which are connected to one another to form the run-in guide rail 10. In this case, the run-in guide rail 10 has in particular a first component 13 and a second component 14. The first component 13 in this case comprises the first support surface 11. The second component 14 comprises the second support surface 12. The first component 13 is in this case made of a different material than the second component 14, wherein the first component 13 has better mechanical damping properties than the second component 14. The second component 14 is in particular made of steel and the first component 13 is made of a plastic, in particular a nylon plastic, such as a plastics material sold under the trade name Nylatron® GSM at the time of the application. In this way, the first component 13 has an elastically more resilient design than the second component 14. The use of different materials for the components 13, 14 is in this case based in particular on the fact that the first component 13 and the second component 14 are intended to fulfil different functions. Here, the second support surface 12 is intended to fully support the track rollers of the step chain and the weight supported by them, wherein the track rollers roll over the second support surface 12. On the other hand, the first support surface 11 is intended to offer little support to the buffer rollers and possibly the step chain, in particular without the first support surface 11 being subjected to actions of load caused by the polygon effect. The first running surface 11 is in this case intended in particular to prevent the occurrence of vibrations in the step chain during the run-in into a sprocket, wherein the first running surface 11 is in particular intended to prevent a downward vibration.

In the exemplary embodiment shown in FIG. 1, the first component 13 is mounted via connecting elements 19, in particular screws, at the second component 14. In this exemplary embodiment, the first component 13 is also supported in this case by a supporting edge of the run-in guide rail 10.

In this exemplary embodiment, the first support surface 11 has a smaller width than the second support surface 12. The width of the first support surface 11 is in this case advantageously adapted to a sprocket and the step chain to be used, in such a manner that the buffer rollers of the step chain can run into the sprocket and, in so doing, are supported at a side region of the buffer rollers by the first support surface 11 of the run-in guide rail 10. The first support surface 11 therefore does not support the buffer rollers over the entire roller width. Furthermore, the first support surface 11 and the second support surface 12 are arranged offset with respect to one another in terms of height, namely by the magnitude of the difference between the radius of the track rollers and the radius of the buffer rollers of the step chain.

In this exemplary embodiment, the first support surface 11 and the second support surface 12 are not completely planar over the entire longitudinal extent. The support surfaces 11, 12 exhibit the same height constantly, that is to say are unchanged, over the width of the respective support surface 11, 12. On the other hand, in the longitudinal extent direction of the run-in guide rail 10, the support surfaces 11, 12 vary in terms of height, so that the first support surface 11 and the second support surface 12 exhibit a first height profile 15 and a second height profile 16 respectively which changes over the longitudinal extent.

The second support surface 12 in this case—with regard to the illustration in FIG. 1—has a second height profile 16 from left to right which initially runs constantly at the same height, then exhibits an absolute maximum 17 towards the end of the second support surface 12, wherein the second height profile 16 then ends from this maximum 17 in a falling curve. In this right-hand portion of the second support surface 12, the second component 14 therefore forms, as it were, a lug. The falling curve of the second height profile 16 in this case follows the circular path which is described by a track roller when the track roller is deflected by the sprocket beyond the dead centre of the sprocket.

The first height profile 15 of the first support surface 11 is determined by the trajectories of those buffer rollers of a step chain which lie between two track rollers in the step chain, in other words are arranged at those points of a step chain at which there are no track rollers. Here, assuming a simplified, theoretical curve profile which is described by the buffer rollers arranged between two consecutive track rollers during the run-in into a sprocket, disregarding the dead weight, the minima of these curve profiles are determined. At the points at which these theoretical minima lie, the first height profile 15 is determined in such a manner that it touches these theoretical minima, which would actually lie lower on account of the actual dead weight. The remaining first height profile 15 in this case remains below the theoretical curve profiles. The transitions in this case however take place very harmoniously, in particular with small gradients, in order to further reduce vibrations. Owing to the dead weight which is actually present, the buffer rollers of the step chain are supported by the first support surface 11. A load caused by the polygon effect is not applied to the first support surface.

It is the intention for there to be no support for the buffer rollers beyond the dead centre of a sprocket, which is why the first support surface 11 is shorter than the second support surface 12.

Figure 2:
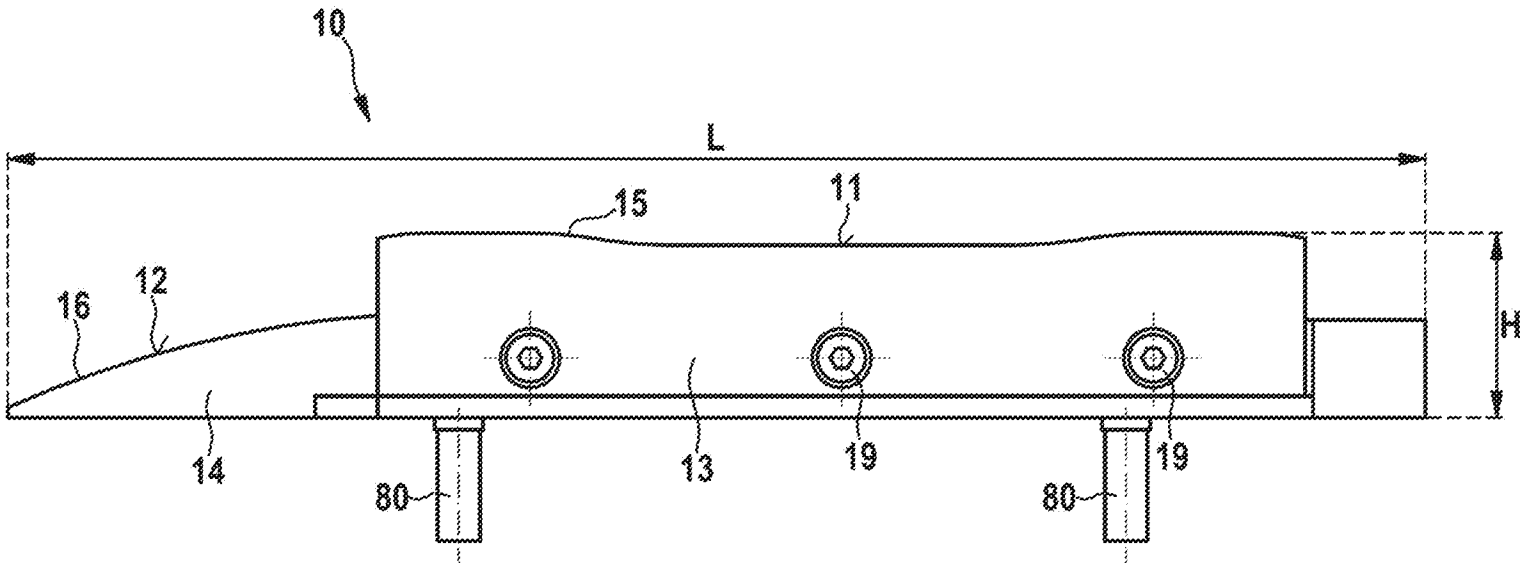
FIG. 2 is a side view of a further exemplary embodiment of the configuration of a run-in guide rail.

FIG. 2 shows a further exemplary embodiment of a run-in guide rail 10, wherein the run-in guide rail 10 shown in FIG. 2 substantially illustrates a side-on illustration of the run-in guide rail 10 shown as a perspective view in FIG. 1.

In the embodiment according to FIG. 2, the run-in guide rail 10 which is configured for supporting a step chain with buffer rollers arranged internally and track rollers arranged externally during the run-in into a sprocket comprises a first support surface 11 for supporting the buffer rollers and a second support surface 12, arranged alongside the first support surface 11, for supporting the track rollers. A first component 13 of the run-in guide rail 10 in this case has the first support surface 11 and a second component 14 has the second support surface 12. As can be seen particularly clearly in FIG. 2, the first support surface 11 and the second support surface 12 are arranged offset with respect to one another in terms of height H. The reason for this is that it is the intention for a step chain with buffer rollers arranged within the chain links and track rollers arranged outside the chain links is to be supported by means of the run-in guide rail 10, wherein the track rollers have a larger diameter than the buffer rollers. As can likewise be seen particularly clearly in FIG. 2, the first component 13 has a first height profile 15 which changes over the longitudinal extent direction L of the run-in guide rail 10. The second component 14 also has a wide height profile 16 which changes over the longitudinal extent direction L of the run-in guide rail 10. The first height profile 15 in this case corresponds to the upper line of the first component 13 illustrated in FIG. 2. The second height profile 16 in this case corresponds to the upper line of the second component 14 illustrated in FIG. 2. The respective height profile 15, 16 in this case determines whether the gradient of the respective support surface 11, 12 over the longitudinal extent direction L of the respective support surface 11, 12 is smaller than zero, equal to zero or greater than zero. The first support surface 11 of the first component 13 is in this case substantially determined by the maximum lying on the right in FIG. 2. The maximum lying on the left is in this case configured at this point in order that the first component 13 is mirror-symmetrical in relation to a perpendicular assumed to be in the centre of the first support surface 11. This makes the usability of the first component 13 more flexible.

Figure 3:
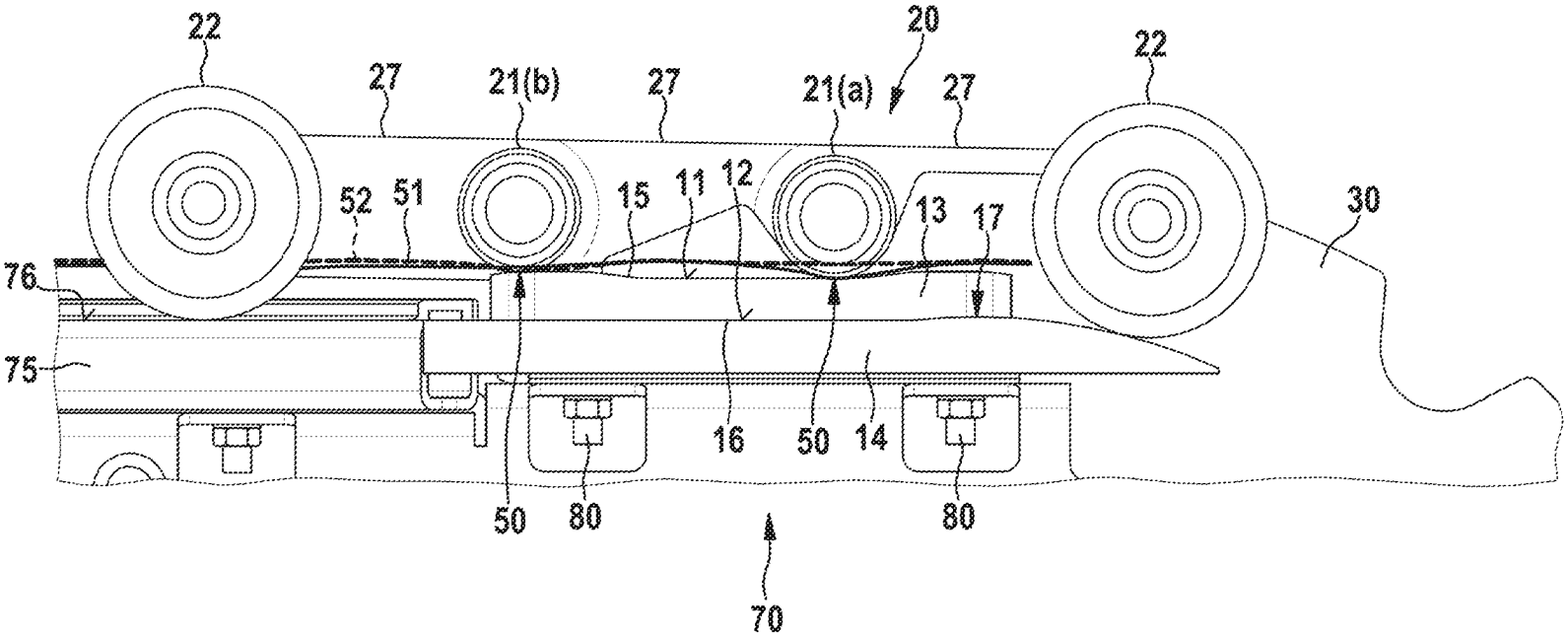
FIG. 3 is a simplified side view of a detail of an exemplary embodiment of a passenger conveyance device.

A small, simplified detail 70 of a passenger conveyance device is illustrated in FIG. 3. Said figure shows, by way of example, a particularly advantageous arrangement of a run-in guide rail 10 as described in particular in connection with FIG. 1. The arrangement of the run-in guide rail 10 in this case takes place by means of the fastening elements 80 of the run-in guide rail 10. The fastening elements 80, which may in particular be threaded bolts, are guided through corresponding receiving means in the passenger conveyance device and secured, in particular by means of locking nuts.

In this case, FIG. 3 illustrates a detail of the sprocket 30 of a passenger conveyance device and also a segment of a step chain 20. Only the rear chain plates 27 of three chain links are shown in this case, in particular in order to make the internally arranged buffer rollers 21 visible. In this exemplary embodiment, the chain pitch may in particular be 135 mm. In this case, an externally arranged track roller 22 is attached at every third connection point of the step chain 20. In other words, in this exemplary embodiment, two buffer rollers 21, namely a first buffer roller 21(*a*) and a second buffer roller 21(*b*), are arranged between two consecutive track rollers 22. The buffer rollers 21 in this exemplary embodiment do not project beyond the chain plates 27 of the step chain 20. In this respect, the buffer rollers 21 have a diameter which is smaller than the height of the chain plates 27.

It can be seen from FIG. 3 that the run-in guide rail 10 is configured for supporting the buffer rollers 21 by means of the support surface 11 during the run-in into the sprocket 30 and for supporting the track rollers 22 by means of the second support surface 12 during the run-in into the sprocket 30, wherein the buffer rollers 21 are supported even when they are already in engagement with the sprocket 30. The run-in guide rail 10 of the passenger conveyance device is in this case arranged alongside the sprocket 30 in such a manner that a side region of the buffer rollers 21 can be supported by the first support surface 11. The run-in guide rail 10 is in this case furthermore arranged in such a manner that the second support surface 12 adjoins a metal rail 75 which has a first running surface 76. Consequently, the track rollers 22 of the step chain 20 are supported in a transition-free manner by the first running surface 76 and then by the second support surface 12. The first support surface 11 in this case starts with an offset in the longitudinal extent direction of the run-in guide rail 10 with respect to the second support surface 12, and is shorter and narrower overall than the second support surface 12.

As is likewise explained with reference to FIG. 1, it is in particular also provided in this exemplary embodiment that the first support surface 11 is made of an elastically more resilient material than the second support surface 12. In particular, it is provided that the first support surface 11 is made of a plastics material, in particular polyamide, and the second support surface 12 is made of metal, in particular of steel or aluminium.

The first support surface 11 of the run-in guide rail 10, as explained with reference to the exemplary embodiment shown in FIG. 1, has a height profile 15 which changes over the longitudinal extent direction of the run-in guide rail 10. The same applies to the second support surface 12, which likewise has a height profile 16 which changes over the longitudinal extent direction of the run-in guide rail 10. The first height profile 15 is in this case defined by the theoretical curve profiles of the buffer rollers 21, in other words those curve profiles which are described by the buffer rollers 21, disregarding the dead weight, during the run-in of the step chain 20 into the sprocket 30. The curve 51 in this case represents the curve profile of the first buffer roller 21(*a*). The curve 52 represents the curve profile of the second buffer roller 21(*b*). The first height profile 15 is defined in such a manner that the first support surface 11 is tangent to the minimum turning points 50 of these theoretical curves 51, 52, wherein the first support surface 11 otherwise remains slightly below the theoretical curves 51, 52. Owing to the actual dead weight of the step chain 20, the buffer rollers 21 are actually supported over an extensive part of the first support surface 11. The embodiment of the first support surface 11 with the height profile 15 defined by the minimum turning points 50 of the theoretical curves 51, 52 means, however, that an application of force to the first support surface 11 owing to the polygon effect is prevented.

The second height profile 16 of the second support surface 12 is initially flat to begin with, viewed from left to right with regard to the illustration in FIG. 3, and rises before the dead centre of the sprocket 30 to a maximum 17, and then follows the circular path described by a track roller 22 when the step chain, in the corresponding chain portion, is in engagement with the sprocket. The maximum of the second height profile 16 in this case lies in the region of the dead centre of the sprocket 30.

Figure 4:
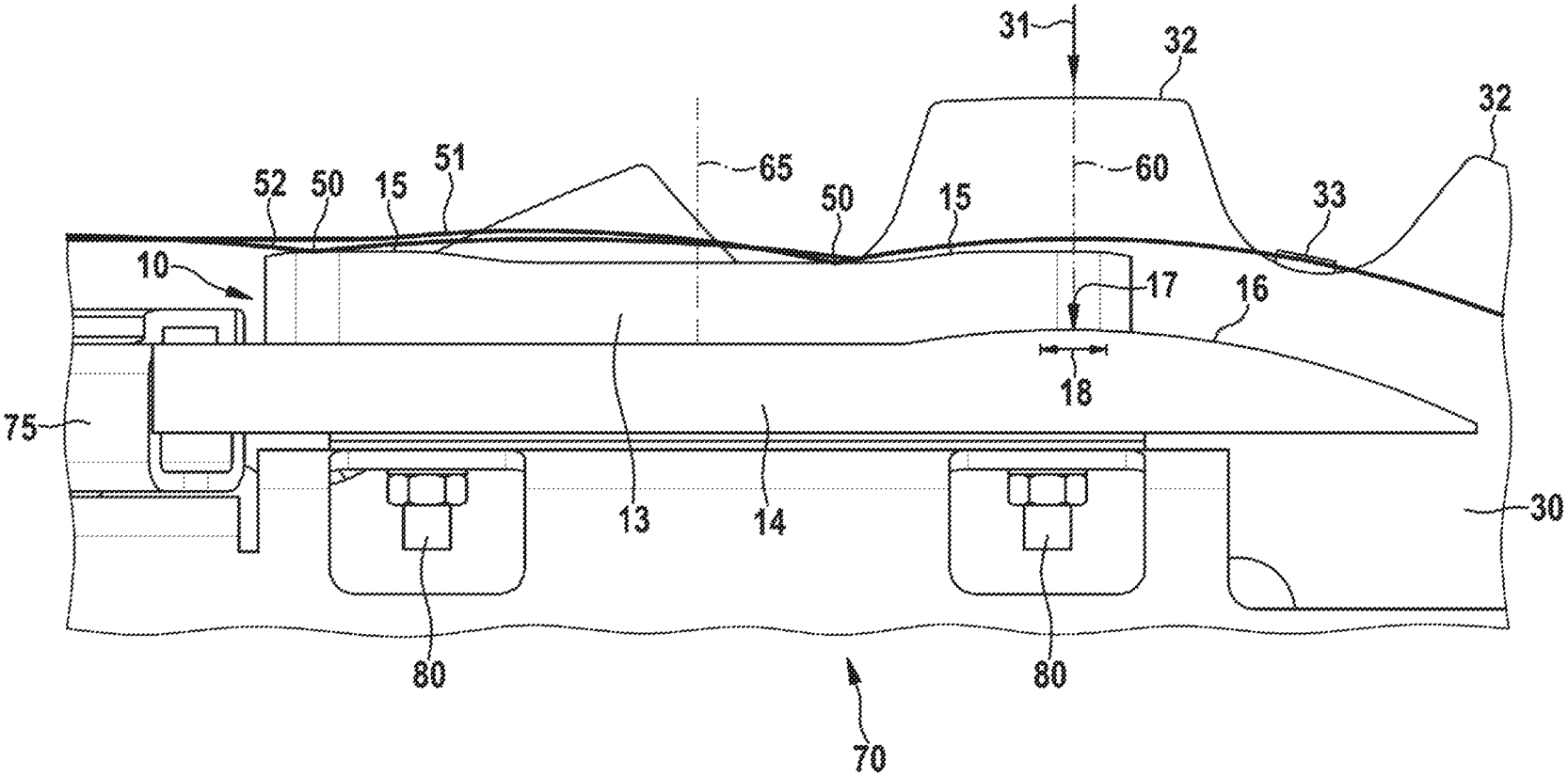
FIG. 4 is a simplified view of an exemplary embodiment of a configuration of a run-in guide rail arranged in a designated manner.

FIG. 4 shows an even smaller detail 70 of a passenger conveyance device, wherein the run-in guide rail 10 arranged in a designated manner is illustrated on an enlarged scale in relation to FIG. 3. In this exemplary embodiment, the run-in guide rail 10 may have a total length of 350 mm. The step chain of the passenger conveyance device is not illustrated in FIG. 4, but said figure does show the curves 51, 52 that would theoretically be described by the buffer rollers, arranged between two consecutive track rollers, of the step chain. Here, FIG. 4 shows once again the way in which the first support surface 11 of the run-in guide rail 10 is determined by the minimum turning points 50 of the curves 51, 52. Also illustrated in FIG. 4 is a perpendicular 65 running through the centre of the first component 13. The first component 13 and therefore in particular also the first support surface 11 are configured in this case in a mirror-symmetrical manner with respect to this perpendicular 65.

Moreover, FIG. 4 symbolically illustrates the dead centre 31 of the sprocket 30, wherein the maximum 17 of the second support surface 12 in this exemplary embodiment is located precisely at of the perpendicular projection 60 of the dead centre 31 of the sprocket 30 onto the second support surface 12. In particular owing to manufacturing tolerances, however, it may be necessary for the run-in guide rail 10 to be arranged in such a manner that the maximum 17 is not located precisely at the perpendicular projection 60 of the dead centre 31 of the sprocket 30 onto the second support surface 12. The maximum 17 may, for this purpose, vary in a region 18 about the perpendicular projection 60 of the dead centre 31 of the sprocket 30 onto the second support surface 12. It is preferable in this case for the region 18 to begin up to 10 mm, in particular up to 5 mm, before the perpendicular projection 60 and to end up to 10 mm, in particular up to 5 mm, after the perpendicular projection 60.

By means of the run-in guide rail 10, it is achieved here in particular that the buffer rollers of a step chain constantly run into the sprocket 30 at the same height, which benefits quiet running. In addition, damping elements 33 used between the teeth 32 of the sprocket 30 are advantageously uniformly loaded and thus uniformly worn, as a result of which quiet running is improved still further.

It is explicitly pointed out that other chain pitches may also be provided, as a result of which the ratio of track rollers to buffer rollers changes. For example, it is provided that the run-in guide rail is designed for supporting step chains in which only one buffer roller is arranged between two consecutive track rollers, but also for supporting step chains in which three buffer rollers are arranged between two consecutive track rollers. This means that in particular the first height profile 15 of the first support surface 11 is changed. This is because a different chain pitch or a different ratio of track rollers to buffer rollers means that the curve profiles of the buffer rollers arranged between the track rollers change. However, the first height profile 15 of the first support surface 11 is likewise determined by the respective minimum turning points of the correspondingly changed curve profiles, in particular in the manner explained for the example with two buffer rollers lying between two consecutive track rollers, wherein, in the case of a greater number of buffer rollers, a correspondingly greater number of minimum turning points have to be taken into account.

The exemplary embodiments illustrated in the figures and explained in connection therewith are used to explain the invention and do not serve to restrict it.

LIST OF REFERENCE NUMBERS

10 run-in guide rail
11 first support surface
12 second support surface
13 first component
14 second component
15 first height profile
16 second height profile
17 maximum of the second height profile (16)
18 region about a perpendicular projection (60) of the dead centre (31) of the sprocket (30) onto the second support surface (12)
19 connection element
20 step chain
21 buffer roller
21(*a*) buffer roller
21(*b*) buffer roller
22 track roller
27 chain plate
30 sprocket
31 dead centre of the sprocket (30)
32 tooth of the sprocket (30)
33 damping element
50 minimum turning points of the buffer rollers during the run-in into a sprocket
51 curve profile of first buffer rollers (21(*a*))
52 curve profile of second buffer rollers (21(*b*))
56 circular path of track rollers (22)
60 perpendicular projection of the dead centre (31) of the sprocket (30) onto the second support surface
65 perpendicular which runs through the centre of the first component (13)
70 detail of a passenger conveyance device
75 metal rail
76 first running surface
80 fastening element
H height
L longitudinal extent direction

What is claimed is:

1. A run-in guide rail for escalators or moving walkways, the run-in guide rail configured to support a step chain with buffer rollers arranged internally and track rollers arranged externally during the run-in into a sprocket; the run-in guide rail comprising:

a first support surface configured to support buffer rollers; and a second support surface disposed alongside the first support surface, the second support surface configured to support track rollers, wherein a first height profile of the first support surface has a longitudinal extent direction and changes in height over the longitudinal extent direction of the run-in guide rail.

2. The run-in guide rail of claim 1 wherein the first support surface is made of a first material and the second support surface is made of a second material, wherein the first material is more elastically resilient than the second material.

3. The run-in guide rail of claim 2 wherein the first support surface is made of a plastic and the second support surface is made of metal.

4. The run-in guide rail of claim 1 wherein the first support surface and the second support surface are arranged offset with respect to one another in terms of height.

5. The run-in guide rail of claim 1 wherein a first piece of the run-in guide rail is a first component which includes the first support surface and a second piece of the run-in guide rail is a second component which includes the second support surface.

6. The run-in guide rail of claim 5 wherein the first component and the second component are connection-free.

7. The run-in guide rail of claim 5 wherein the first component is mounted at the second component.

8. The run-in guide rail of claim 1, wherein the first height profile corresponds to a chain pitch of the step chain.

9. The run-in guide rail of claim 8 wherein starting from a designated arrangement position of the run-in guide rail for the support of the step chain during the run-in into a sprocket, the first height profile is configured such that, disregarding the dead weight of the step chain, said first height profile describes the minimum turning points of the at least one buffer roller, which is arranged between two track rollers, during the run-in into the sprocket.

10. The run-in guide rail of claim 1, wherein a second height profile of the second support surface changes over the longitudinal extent direction of the run-in guide rail.

11. The run-in guide rail of claim 10 wherein, starting from a designated arrangement position of the run-in guide rail for the support of the step chain during the run-in into a sprocket, the second height profile is determined such that the second height profile exhibits a maximum which lies in a region about a perpendicular projection of the dead centre of the sprocket onto the second support surface, wherein the region begins up to 10 mm before the perpendicular projection and ends up to 10 mm after the perpendicular projection.

12. The run-in guide rail of claim 11 wherein the second height profile of the second support surface describes a falling curve starting from the maximum beyond the perpendicular projection of the dead centre, wherein the falling curve follows the circular path which a track roller of the driven step chain covers in this run-in guide rail portion.

13. The run-in guide rail of claim 10 wherein the first height profile and/or the second height profile is/are mirror-symmetrical in relation to a perpendicular running through the run-in guide rail.

14. A passenger conveyance device comprising:

at least one step chain with buffer rollers arranged internally and track rollers arranged externally;

at least one sprocket and comprising at least one run-in guide rail according to claim 1.

15. The passenger conveyance device of claim 14 wherein each respective run-in guide rail is arranged in relation to each respective sprocket such that the first support surface faces towards the sprocket, so that the buffer rollers of the respective step chain are supported during the run-in into the sprocket in a side region of the respective buffer rollers by the first support surface, and wherein the second support surface faces away from the sprocket, so that the track rollers of this step chain are supported during the run-in into the sprocket by the second support surface.

* * * * *